US005547306A

United States Patent [19]

Zakrajsek

[11] Patent Number: 5,547,306

[45] Date of Patent: Aug. 20, 1996

[54] FASTENER ASSEMBLY

[75] Inventor: Jerry Zakrajsek, Fredonia, Wis.

[73] Assignee: DCI Marketing, Inc., Milwaukee, Wis.

[21] Appl. No.: 310,282

[22] Filed: Sep. 21, 1994

[51] Int. Cl.[6] ..... G09F 21/04

[52] U.S. Cl. ..... 403/202; 403/387; 40/591; 40/631; 40/911

[58] Field of Search ..... 40/591, 631, 663, 40/911; 403/387, 202

[56] References Cited

U.S. PATENT DOCUMENTS

| | | | |
|---|---|---|---|
| 1,589,681 | 6/1926 | Carlson et al. | 40/591 |
| 4,691,457 | 9/1987 | Peroni | 40/1.6 X |
| 5,027,537 | 7/1991 | Freeman et al. . | |

FOREIGN PATENT DOCUMENTS

| | | | |
|---|---|---|---|
| 494036 | 10/1938 | United Kingdom | 40/591 |

*Primary Examiner*—Anthony Knight
*Attorney, Agent, or Firm*—Godfrey & Kahn, S.C.

[57] ABSTRACT

A fastener assembly for engaging a lattice-like structure. The fastener assembly includes a main body having individual portions which interact with a vertical component of the lattice. An object of interest, having a plate upon which an emblem or decorative ornament may be mounted, is borne by the main body and operable to be releasably secured on it. The object of interest may be fastened or otherwise fixed to the main body by a fastener which is operable to engage the main body and the object of interest thus securing the main body and the object of interest on the lattice-like structure.

20 Claims, 4 Drawing Sheets

FASTENER ASSEMBLY

BACKGROUND OF THE INVENTION

1. Field of the Invention

The present invention relates to a fastener assembly for fixing an object of interest to a second object of interest, and more particularly to a fastener assembly which is useful for releasably affixing an object of interest to a lattice-like structure.

2. Description of the Prior Art

The prior art is replete with numerous examples of assorted fasteners, each useful for a particular application. Typically, the specific application will determine the type of fastener chosen. For example, certain geometric structures prohibit the use of commonly used fasteners which employ rivets, screws and the like in view of the difficulties encountered in the installation of same. In particular, a lattice-like structure presents an unusually difficult geometry for the utilization of common fasteners.

As should be understood, contemporary fasteners are often difficult to install in assorted substrates or otherwise require special tools for the installation of same. Further, these same fasteners, under some circumstances, may damage the structure which they are affixed to. Additionally, fasteners which do not damage the underlying substrate or structure are often not reliable when exposed to adverse environmental conditions such as continuous vibration, extremes in temperature, exposure to U.V. radiation, and forceable impact, to name but a few.

As of late, certain manufacturers of luxury automobiles have engaged in numerous purchaser incentive programs which have endeavored to award their repeat customers with assorted distinctive indicia for use on their automobiles. Such an award may depict the number of automobiles purchased from that specific manufacturer. These awards may take on one of several forms including emblems or badges which may be displayed prominently upon the grill of the automobile. As a general matter, these awards are highly prized by the owner of the automobile. To permit this emblem to be displayed on the grill of an automobile, it is necessary to utilize a fastener which will not damage the underlying lattice-like structure but will operate effectively to secure the emblem in place under adverse environmental conditions. Further, in view of the fact that the fastener will normally be installed by the purchaser of the automobile, it is essential that the fastener be easy to utilize. Furthermore, the fastener should have a design which discourages the theft of the emblem. In addition to the foregoing, the fastener should be of a design which requires only a minimum number of tools for installation. Lastly, the fastener must securely affix the emblem on the automobile grill in such a fashion that it does not vibrate or rattle under normal operational conditions.

Therefore, it has long been known that it would be desirable to have a fastener assembly which can be utilized to fasten an object of interest on a lattice-like structure and which simultaneously secures the object in a predetermined location, and yet does not damage the underlying structure, and which further can be easily installed, and which additionally is theft resistant.

OBJECTS AND SUMMARY OF THE INVENTION

Therefore, it is an object of the present invention to provide an improved fastener assembly for fastening an object of interest to another object of interest.

A further object of the present invention is to provide a fastener assembly for fastening an object of interest to another object of interest, and which is characterized by ease of installation, simplicity of construction, and which further can be manufactured and sold at a nominal price.

A further object of the present invention is to provide a fastener assembly for fastening an object of interest to another object of interest, and wherein the fastener assembly may be installed and later accessed from only one side of the object.

A further object of the present invention is to provide a fastener assembly for fastening an object of interest to another object of interest, and wherein the fastener assembly is manufactured of a rigid, resilient, yet corrosion resistant substance.

A further object of the present invention is to provide a fastener assembly for fastening an object of interest to another object of interest, and wherein the fastener assembly securely engages the first object of interest thereby inhibiting the vibration of the second object of interest.

A further object of the present invention is to provide a fastener assembly for fastening an object of interest another object of interest, and wherein the fastener assembly will withstand prolonged exposure to adverse ambient environmental conditions without suffering failure.

A further object of the present invention is to provide a fastener assembly for fastening a first object of interest to a second object of interest, and wherein the fastener assembly provides deterrence to the theft or unauthorized removal of the second object of interest.

Further objects and advantages of the present invention are to provide improved elements and arrangements thereof in the fastener assembly for the purposes described and which is dependable, economical, durable and fully effective in accomplishing its intended purposes.

These and other objects and advantages are achieved in the fastener assembly of the present invention and which includes a main body having first, second, third and fourth courses, and wherein the first course includes forwardly and rearwardly disposed surfaces, and first and second ends, and a mid-point therebetween, and wherein the second course is oriented substantially perpendicular to first course and further is fixed on the first course at substantially the mid-point of the first course, and which further extends normally outwardly relative to the forwardly disposed surface of the first course, and wherein the third course is oriented substantially perpendicular to the first course, and further is fixed on the first course on the first end of the first course, and which further extends normally outwardly relative to the forwardly disposed surface of the first course, and wherein the fourth course is oriented substantially perpendicular relative to the first course, and further is fixed on the second end of the first course and which further extends normally outwardly relative to the forwardly disposed surface of the first course, and wherein the second, third and fourth courses each include individual coaxially aligned apertures which are operable to receive a fastener; and a second object of interest is releasably secured on the main body by the fastener, and wherein the second, third, and fourth courses are spaced a predetermined distance apart and are operable to engage the first object of interest thereby securing the second object of interest on the first object of interest.

These and others objects and advantages of the present invention will become more apparent from the following detailed description of the preferred embodiment of the present invention taken in combination with the accompanying drawings.

DESCRIPTION OF THE PREFERRED EMBODIMENT

Figure 2:
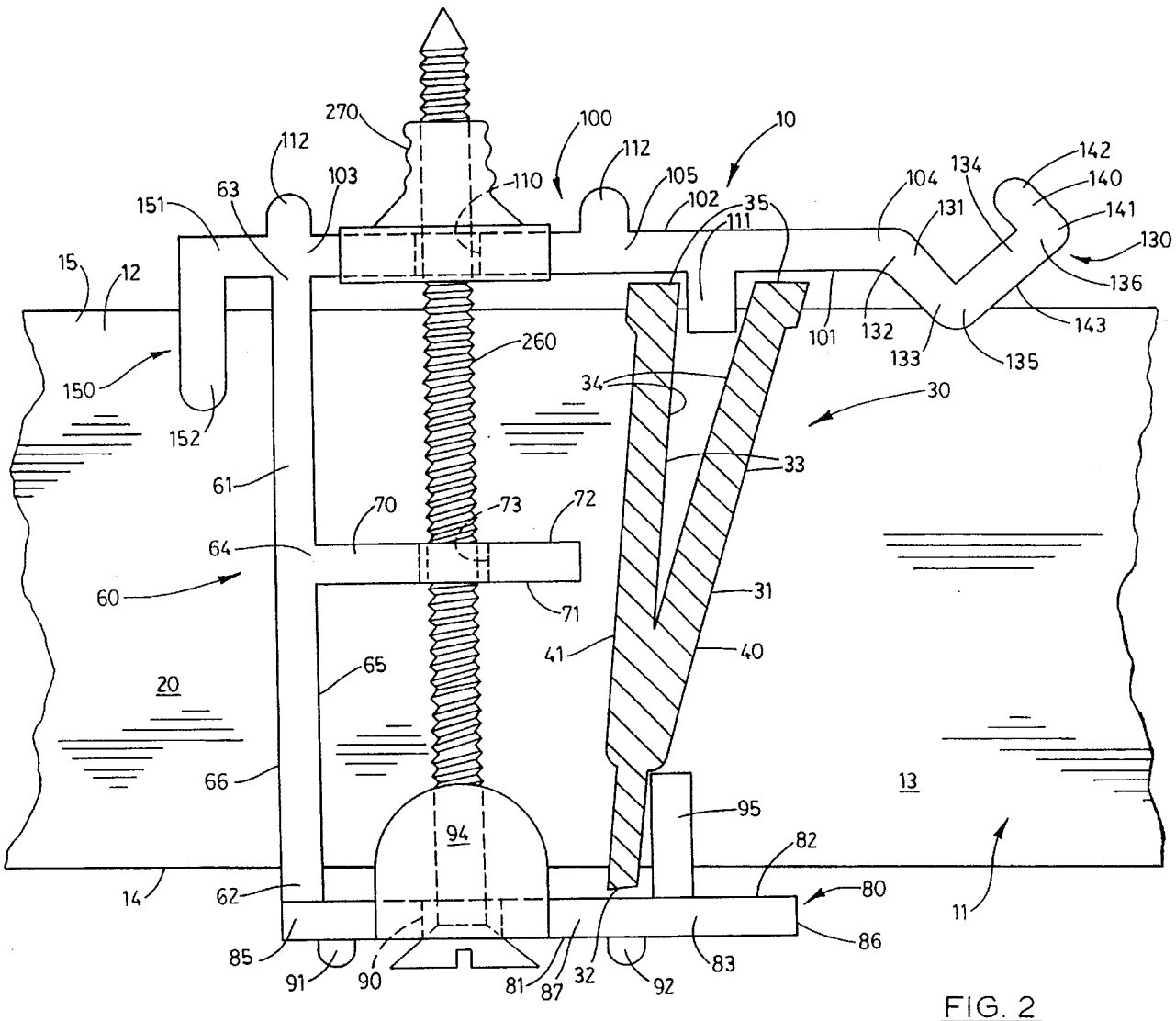
FIG. 2 is a longitudinal, vertical, cross-sectional view of the fastener assembly of the present invention, and which is taken from a position along line 2—2 of FIG. 1, and which further illustrates the fastener assembly of the present invention in an operational position relative to the lattice-like structure of an automotive grill.
Figures 3, 4:
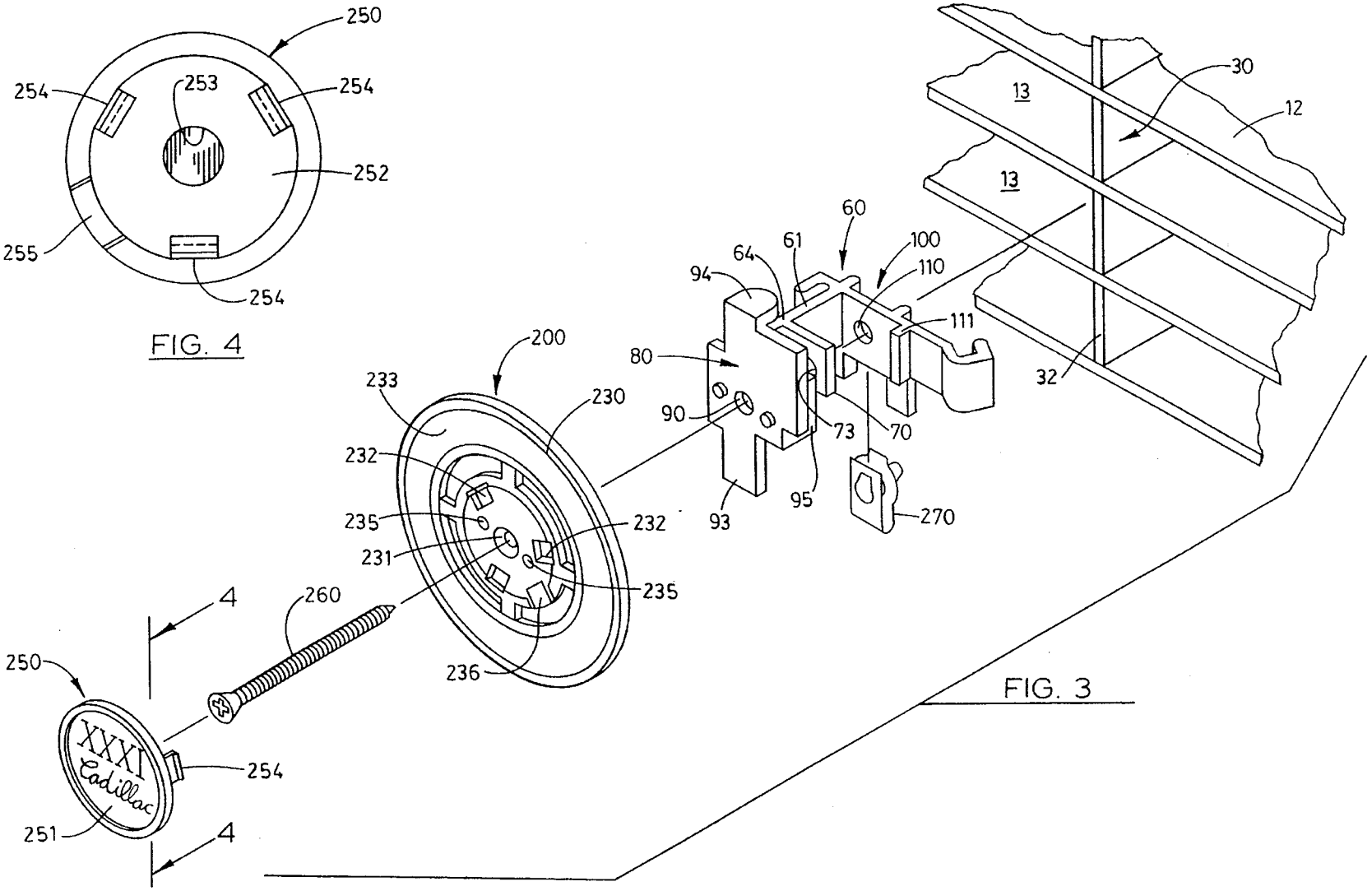
FIG. 3 is a partial, perspective, environmental, exploded view of the fastener assembly of the present invention.
FIG. 4 is a plan view of a second plate utilized in combination with an emblem or decorative ornament of the present invention, and which is taken from a position along line 4—4 of FIG. 3.
Figure 5:
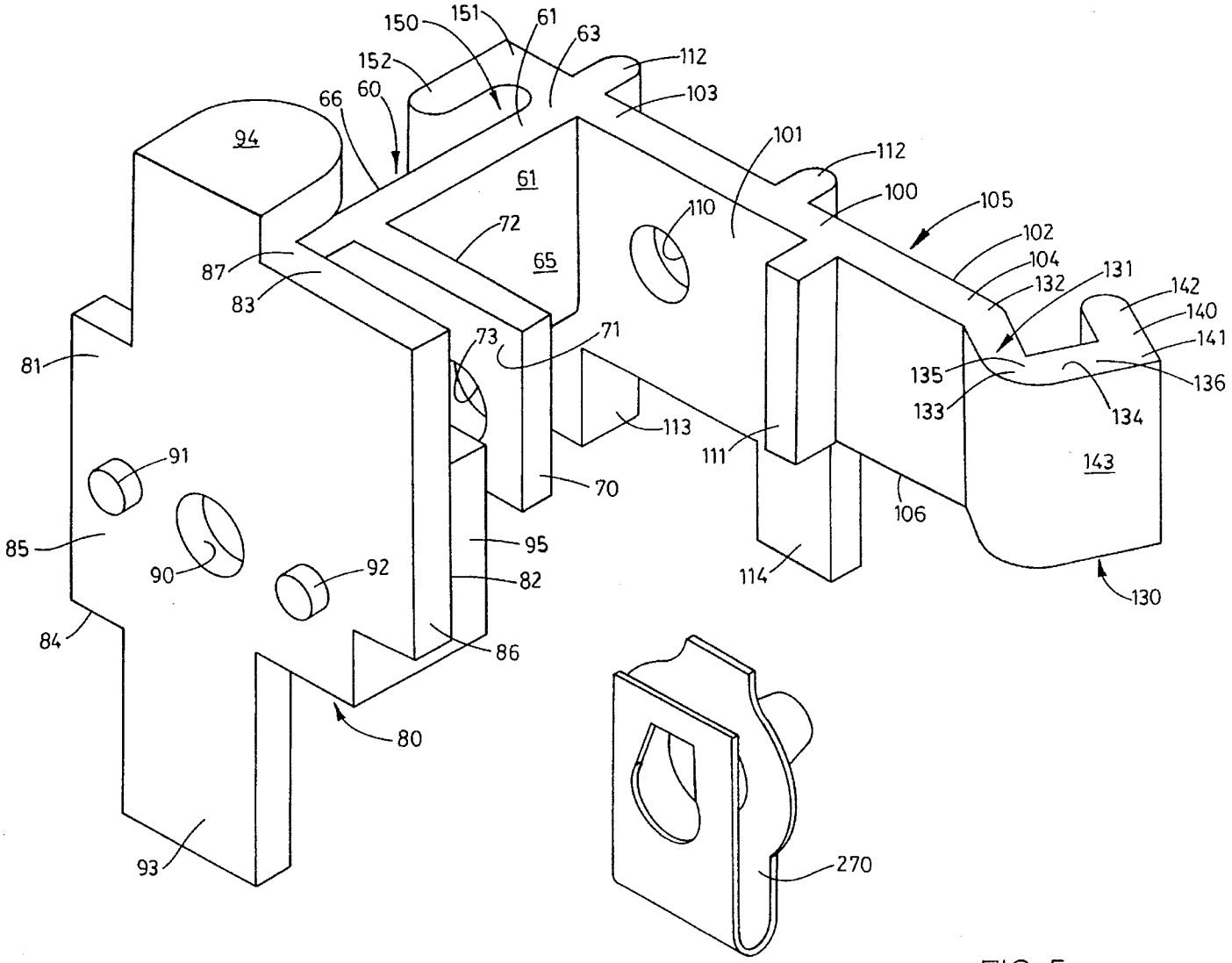
FIG. 5 is a greatly enlarged, perspective view of the fastener assembly shown in FIG. 3.

Referring more particularly to the drawings, the fastener assembly of the present invention is designated generally by the numeral 10 and is best appreciated by a study of FIGS. 2, 3 and 5. The fastener assembly 10 is operable to interact or be connected to an object of interest 11 which is illustrated herein as an automotive grill 12, although it will be recognized that the fastener assembly 10 may be utilized in combination with other types of lattice-like structures.

The automobile grill 12 is positioned on the front end of an automobile (not shown). The grill 12 has a lattice-like geometry and consists of a plurality of substantially horizontally oriented and equally spaced components 13. Each of these components includes a leading edge 14, and a trailing edge 15. In addition, each of the substantially horizontally oriented components possess an upper facing surface 20, and a lower facing surface 21. The automobile grill also includes a plurality of substantially vertically oriented and equally spaced components 30. Each of the vertically oriented and equally spaced components has a main body 31, which includes a leading edge 32, and a pair of legs which are generally designated by the numerals 33. The individual legs form a "Y" shape when viewed along the longitudinal axis of the individual vertical components. This is best illustrated by reference to FIG. 2. The individual legs define a gap or space 34 therebetween. Further, each of the legs possesses a substantially vertically oriented trailing edge 35. In addition to the foregoing, the right leg [as seen in FIG. 2] defines an outwardly facing surface 40; and the left leg [as seen in FIG. 2], defines a similarly outwardly facing surface 41. The individual vertical components intersect with each of the horizontal components thereby forming a plurality of generally rectangular interstices 50 which individually permit air flow to the radiator of the automobile, not shown.

As best seen by reference to FIG. 2, the fastener assembly 10 has a main body which is generally indicated by the numeral 60, and which includes a number of individual courses or portions which will be discussed in greater detail hereinafter. In this regard, the main body has a generally planar first course 61 which possesses a first end 62, a second end 63, and a mid-point 64 therebetween. Further, the first course also has a forwardly disposed surface 65; and a rearwardly disposed surface 66.

Affixed on the first course 61, at the mid-point thereof, 64, and extending perpendicularly outwardly therefrom relative to the forwardly disposed surface of the first course is a generally planar second course 70. The second course includes a first or forwardly facing surface 71, and an opposite, second, or rearwardly facing surface 72. Further, an aperture 73 is formed in the second course and extends therethrough from the first to second surfaces.

Affixed on the first course 61, at the first end 62, and extending substantially perpendicularly outwardly therefrom relative to the forwardly disposed surface 65 is a generally planar third course 80. The third course has a forwardly disposed surface 81, and a rearwardly disposed surface 82, as well as a upper peripheral edge 83, and a lower peripheral edge 84. In addition to the foregoing, the third course has a first end 85; second end 86; and a mid-point 87 therebetween. The third course has a centrally disposed aperture 90 formed therein. Made integral with the forwardly disposed surface 81 are a pair of orientation tabs or posts 91 and 92, respectively. The individual posts are spaced substantially equidistantly from the aperture 90. Additionally, and depending downwardly from the lower edge of the third course, and disposed in substantially the same plane as the third course, is a generally rectangular-shaped brace 93. A semi-circular shaped protrusion 44 extends rearwardly from the upper peripheral edge 83. Further, and extending substantially normally rearwardly from the rearwardly disposed surface 82 of the third course, at substantially the second end thereof, is a generally rectangular protrusion 95.

Affixed on, or made integral with, the first course 61 at the second end 63 of the first course and extending perpendicularly outwardly from the forwardly disposed surface 65 of the first course is a generally planar-shaped fourth course and which is generally indicated by the numeral 100. The fourth course has a forwardly disposed surface 101, and a rearwardly disposed surface 102. In addition, the fourth course has a first end 103, a second end 104, a mid-point 105, and a lower peripheral edge 106. The fourth course has an aperture 110 formed therein. As best understood by reference to FIG. 5, the apertures formed in the second, third and fourth courses (73, 90 & 110) are substantially coaxially aligned. The fourth course further includes a locking member 111 which extends perpendicularly outwardly from the forwardly disposed surface 101 at a location between the first and second ends. In addition, the rearwardly disposed surface 102 of the fourth course includes two orientation channels, or ridges which are made integral therewith, and which are generally indicated by the numeral 112. As been seen in FIG. 2 the ridges are spaced substantially equidistantly from the aperture 110. In addition to the foregoing, and depending downwardly from the lower peripheral edge 106 of the fourth course, are two generally rectangular-shaped braces which are designated 113 and 114, respectively. The first brace extends downwardly from the first end of the fourth course and the second brace 114 is positioned intermediate the first and second ends and extends normally downwardly relative thereto.

As best seen by reference to FIG. 5, the fourth course 100 includes a camming or engagement member which is generally designated by the numeral 130. The camming member is composed of several courses. The first course 131 of the camming member has a first end 132, and a second end 133.

The first end is angularly disposed relative to the second end 104 of the fourth course 100. Further, the first course of the camming member extends generally forwardly relative to the forwardly disposed surface 101 of the fourth course. The second course 134 of the camming member has a first end 135, and a second end 136. The first end 135 is perpendicularly oriented relative to the second end 133 of the first course of the Camming member. Additionally, the second course of the camming member extends generally rearwardly relative to fastener 10. The third course 140 of the camming member has a first end 141 and a second end 142. The first end 141 is substantially perpendicularly oriented relative to the second end 136 of the second course 134 of the camming member. Further, the third course of the camming member 140 extends generally rearwardly. The arrangement of first, second and third courses of the camming member forms a generally hook-shaped member with the open end of the hook facing generally rearwardly of the fastener assembly 10. Additionally, a camming surface 143 is created by the combination of the forwardly disposed surfaces of the hook-shaped member. Still further, the fourth course 100 includes a slot 150 which is formed by two courses 151 and 152, respectively, which are oriented substantially normally relative to each other, and wherein the course 151 extends substantially longitudinally outwardly relative to first end 103 of the fourth course 100 and the second course extends forwardly relative to the forwardly facing surface of the fourth course thereby defining the slot.

As noted earlier, the fastener assembly 10 of the present invention finds particular utility in mounting a second object of interest 200 on the first object of interest 11. In this regard the fastener assembly 10, as noted earlier, finds particular utility in fastening or otherwise releasably securing an emblem or decorative ornament on the grill 12 of an overland vehicle (not shown). In this regard, the second object of interest 200 includes a first plate 230 which has a forwardly disposed surface 233, and a rearwardly disposed surface, not shown. The first plate has a centrally disposed aperture 231 formed therein. In addition, the first plate has three locking apertures 232 formed therein which are radially disposed in a predetermined pattern about the centrally disposed aperture 231 of the first plate. The plate also has formed therein a pair of orientation tab receiving apertures 235 which are spaced a predetermined distance from the centrally disposed aperture of the first plate, and are operable to matingly receive in interfitted relation the individual post 91, and 92. The third plate further includes a beveled recess 236 which is formed in the forwardly facing surface at a predetermined distance from the aperture 231.

Figure 1:
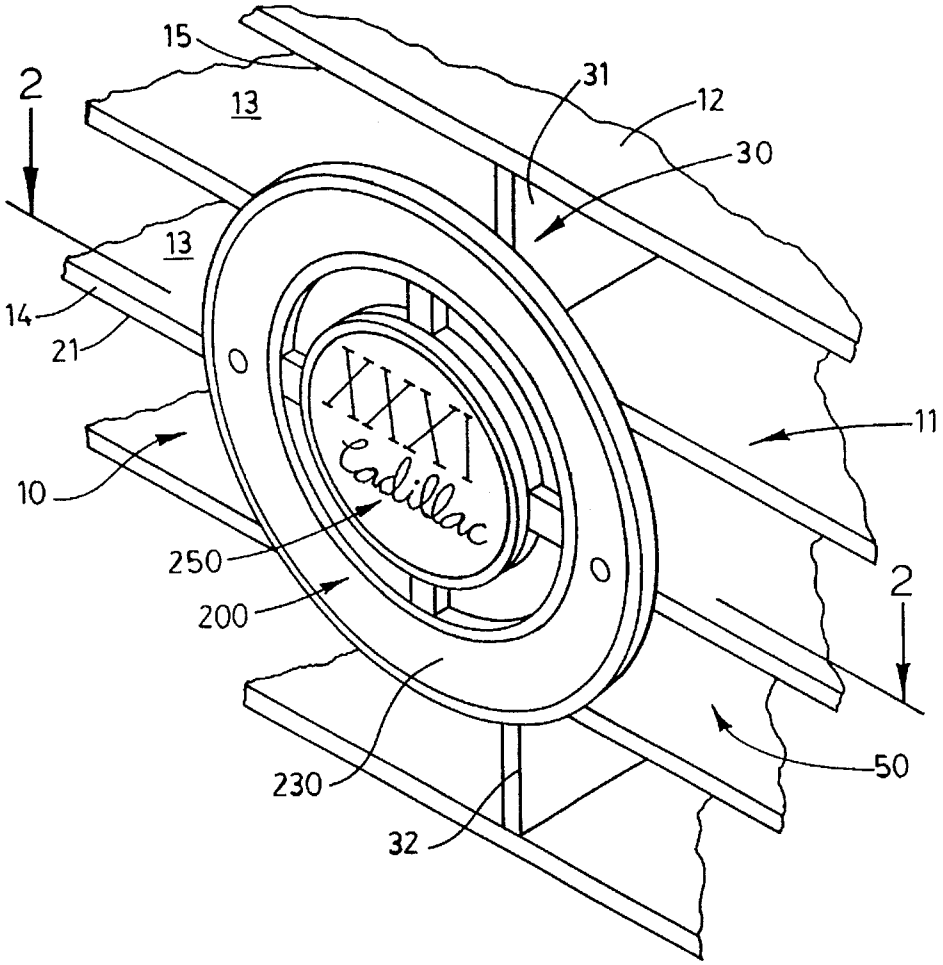
FIG. 1 is a partial, perspective, environmental view of the fastener assembly of the present invention, and which is shown in combination with a decorative ornament for use on an automotive grill of conventional design.

As best seen by reference to FIG. 3, the second object of interest 200 includes a second plate 250 which is operable to matingly engage in snap-fitted relation the first plate 230. The second plate 250 has a forwardly facing surface 251 and a rearwardly facing surface 252. As best seen by reference to FIG. 4, the rearwardly facing surface further has a recess 253 formed therein which is operable to receive the head of a fastener which will be discussed in greater detail hereinafter. Further, and extending substantially normally outwardly relative to the rearwardly facing surface are three locking tabs 254 which are radially disposed in a predetermined pattern about the recess. As a general matter, the locking tabs are generally hook-shaped and have predetermined dimensions which permit them to individually matingly snap-fit into releasable interfitted engagement with the first plate by means of the respective locking apertures 232. Additionally, an adhesive pad (not shown) may be positioned in sandwiched relationship therebetween the first and second plates thus adhesively securing the first and second plates together. This is best imagined by a study of FIGS. 1 and 3. The forwardly facing surface 251 of the second plate can be printed or embossed with all manner of indicia as needed by the manufacturer of the automobile to indicate any particular award or number of automobiles purchased. The second plate further includes a beveled recess 255 which is formed in the rearwardly facing surface 252 and which is operable to be aligned with the recess 236 which is formed in the first plate 230.

As best seen by reference to FIG. 3, a threaded fastener 260 is operable to be screwthreadly received in the coaxially aligned apertures 73, 90, 110 and 231, respectively. Further, and as best seen by reference to FIG. 2, a metal clip 270, slidably and matingly interfits with the fourth course, and is operable to screwthreadably mate with the threaded fastener. The clip is matingly received between the two ridges 112 which are mounted on the fourth course 100.

OPERATION

The operation of the described embodiment of the present invention is believed to be readily apparent and is briefly summarized at this point. The fastener assembly 10 of the present invention is operable to engage a lattice-like structure 11 which includes a plurality of substantially horizontally oriented components 13, and a plurality of substantially vertically oriented components 30 which individually include a pair of legs 33, and which further define a gap 34 therebetween. The fastener assembly includes a main body 60 which has individual portions or courses which interact with one of the vertically oriented components of the lattice. An object of interest 200 is borne by the main body and is operable to be releasably secured thereto. A thread fastener 260 is operable to simultaneously engage the main body, and the object of interest, thereby securing the main body 60 and the object of interest on the lattice-like structure.

More specifically, the fastener assembly 10 of the present invention, which is used in combination with a lattice-like structure 12 has a main body 60 having first, second, third and fourth courses or portions, 61, 70, 80, and 100, respectively, and wherein the first course 61 includes forwardly and rearwardly disposed surfaces 65, and 66, respectively; and first and second ends 62, and 63; and a mid-point 64 therebetween. The second course 70 is oriented substantially perpendicular to the first course and further is fixed on the first course at substantially the mid-point of the first course and extends normally outwardly relative to the forwardly disposed surface of the first course. The third course 80 is oriented substantially perpendicular to the first course and further is fixed on the first course at the first end of the first course, and which further extends normally outwardly relative to the forwardly disposed surface of first course. The fourth course 100 is oriented substantially perpendicular relative to first course and further is fixed on the second end of the first course, and which further extends normally outwardly relative to the forwardly disposed surface of the first course. The second, third and fourth courses include individually coaxially aligned apertures 73, 90 and 110 which are operable to receive a fastener 260; and a second object of interest 200 is releasably secured on the main body by the same fastener. The second, third and fourth courses are spaced a predetermined distance apart and are operable to engage the first object of interest hereinafter described as a lattice or grill 12 thereby securing the second object 200 on the first object.

To install the present fastener assembly, an owner would merely slip the main body 60 of the fastener assembly 10 through one of interstices 50 which are defined by the horizontal and vertical components 13 and 30 of the grill 12. Once placed in this position, the leading edge 32 of one of the vertical components 30 would be located in the position as shown in FIG. 2, where it is adjacent the rearward surface of the third course and juxtaposed relative to the rectangular protrusion 95. As best imagined by a study of FIGS. 1 and 2, as the installer begins to press the fastener assembly 10 into engagement with the vertical component, the camming surface 143 engages the trailing edge 35 of the individual legs 33 thereby causing the fourth course 100 to be urged or bent generally rearwardly as viewed in FIG. 4. When this event occurs, the locking member 111 moves into interfitted mating receipt in the gap 34 which is defined between the legs of the vertical component. This action occurs in the nature of a snap-fit. Once the fastener assembly is positioned as shown in FIG. 2, the semicircular protrusion is moved into engagement with an adjacent horizontal component. As should be understood, the brace 93 rests against the leading edge of another adjacent horizontal component (not shown). Following this orientation, the fastener 260 is inserted in the coaxially aligned apertures and threadably mates with the clip 270. During this threaded engagement, the first plate 230 is oriented such that the posts 91, and 92 are received in the apertures 235. Following the orientation and the attachment of same by the fastener 260, the second plate is snap-fitted into engagement with the first plate and then adhesively secured in place by an adhesive pad (not shown).

Removal of the fastener from the grill assembly follows approximately the reverse of what has been discussed above with the exception that a prying tool (not shown) such as a screwdriver will be used.

For example, to remove the second plate 250, a screwdriver (not shown) would be inserted in the space (not shown) which is created when the individual beveled areas 236, and 255 are aligned, and force would be applied to same thereby detaching the first and second plates, 230, and 250, respectively. Once the second plate is removed, the screwdriver would be employed to threadably disengage the threaded fastener 260 from the main body 60 of the fastener assembly 10. Following this step, the screwdriver will be inserted in the slot 150. When force is applied by the screwdriver to the slot, the force causes the fourth course to be distorted or otherwise moved out of engagement with the trailing edge 35 of the grill 12 thereby allowing the fastener assembly to be released from same.

Therefore, it will be seen that the fastener assembly 10 of the present invention provides a convenient means whereby an object of interest 200 may be secured on a lattice-like structure without damage to same, and which further secures the object of interest in a predetermined location and in a fashion which substantially deters the unauthorized removal of same.

Although the invention has been herein shown and described in what has been conceived to be the most practical and preferred embodiment, it is recognized that departures may be made therefrom within the scope of the invention, and is not to be limited to the illustrative details disclosed.

Having described my invention, what I claim as new and desire to secure by Letters Patent of the United States is:

1. A fastener assembly for engaging a substantially vertical component of a lattice structure which includes a plurality of substantially horizontally oriented components, and a plurality of substantially vertically oriented components, the vertical component having a leading edge and a trailing edge, the fastener assembly comprising:

a main body having a first portion which is operable to engage the leading edge of the vertical component, and a second portion which is operable to engage the trailing edge of the vertical component;

an object of interest borne by the main body and operable to be releasably secured on the main body; and a fastener operable to engage the main body and the object of interest thereby securing the main body and the object of interest on the lattice like structure;

where, in operation, the vertical component is sandwiched between the first and second portions.

2. A fastener assembly for engaging a lattice structure which includes a plurality of substantially horizontally oriented components, and a plurality of substantially vertically oriented components which individually include a pair of legs which define a gap therebetween, and wherein the horizontal and vertical components define spaces therebetween, the fastener assembly comprising:

a main body having individual portions which interact with one of the vertically oriented components of the lattice, and wherein the one vertical component of the lattice has leading, and trailing edges, and wherein the vertical component is substantially V-shaped, and the pair of legs are oriented along the trailing edge, and wherein the main body has a first portion which is operable to engage the leading edge, and a second portion which is operable to engage the trailing edge, and wherein the vertical component is sandwiched therebetween;

an object of interest borne by the main body and operable to be releasably secured on the main body; and a fastener operable to engage the main body and the object of interest thereby securing the main body and the object of interest on the lattice like structure.

3. A fastener assembly as claimed in claim 2, and wherein the main body is manufactured from resilient material, and wherein the second portion includes a camming member, and a locking member, and wherein the locking member is disposed in spaced relation relative to the camming member and is matingly received in the gap defined by the individual legs.

4. A fastener assembly as claimed in claim 3, and wherein the first and second portions have individual apertures formed therein which are substantially coaxially aligned, and wherein the fastener is received in the aperture and is operable to urge the first portion toward the second portion thereby causing the first and second portions to securely engage the lattice.

5. A fastener assembly as claimed in claim 4, and wherein the object of interest includes first and second plates, and wherein the first plate has a centrally disposed aperture formed therein which is operable to receive the fastener, and wherein the first plate further includes a plurality of locking apertures, and wherein the second plate includes a plurality of locking tabs which releasably mate with the individual locking apertures thereby securing the first and second plates together, and wherein the first plate and first portion releasably mate, one with the other, thereby orienting the first plate in a predetermined position relative to the first portion.

6. A fastener assembly as claimed in claim 5, and wherein the main body includes a third portion which connects the first and second portions together, and wherein the third portion includes an aperture which is substantially coaxially aligned with the apertures formed in the first and second portions and which receives the fastener therethrough, and wherein the second portion includes an assembly which may be engaged by a prying instrument, and wherein force applied to the assembly causes the second portion to be moved out of engagement with the lattice structure thereby facilitating the fasteners assembly's removal therefrom.

7. A fastener assembly as claimed in claim 6, and wherein the first portion has forwardly and rearwardly facing surfaces, and wherein the rearwardly facing surface of the first portion has a protrusion which is operable to engage the leading edge of the vertical component of the lattice, thereby orienting the main body in a predetermined position relative to the lattice.

8. A fastener assembly for use in combination with a first object of interest, the fastener assembly comprising:

a main body having first, second, third and fourth courses, and wherein the first course includes forwardly and rearwardly disposed surfaces, and first and second ends, and a midpoint therebetween, and wherein the second course is oriented substantially perpendicular to the first course and further is fixed on the first course at substantially the midpoint of the first course and which extends normally outwardly relative to the forwardly disposed surface of the first course, and wherein the third course is oriented substantially perpendicular to the first course and further is fixed on the first course at the first end of the first course and which extends normally outwardly relative to the forwardly disposed surface of the first course, and wherein the fourth course is oriented substantially perpendicular relative to the first course and further is fixed on the second end of the first course and which extends normally outwardly relative to the forwardly disposed surface of the first course, and wherein the second, third and fourth courses include individual coaxially aligned apertures which are operable to receive a fastener; and a second object of interest which is releasably secured on the main body by the fastener, and wherein the second, third and fourth courses are spaced a predetermined distance apart and are operable to engage the first object of interest thereby securing the second object on the first object.

9. A fastener assembly as claimed in claim 8, and wherein the fastener is a threaded fastener.

10. A fastener assembly as claimed in claim 9, and wherein the main body is composed of substantially resilient material.

11. A fastener assembly as claimed in claim 10, and wherein the first object is a lattice structure having a plurality of substantially horizontal and vertical components, and wherein an individual vertical component of the lattice like structure is sandwiched between the third and fourth courses.

12. A fastener assembly as claimed in claim 11, and wherein the fourth course further includes first and second ends and forwardly and rearwardly disposed surfaces, and wherein the fourth course is fixed on the first course at the first end thereof, and wherein the fourth course further includes a camming surface which is positioned on the second end of the fourth course, and which is oriented for engagement with the vertical component.

13. A fastener assembly as claimed in claim 12, and wherein the fourth course further includes an orientation channel, and wherein a fastener engaging clip is received in the orientation channel and is disposed in substantially coaxial alignment relative to the individual coaxially aligned apertures of the second, third and fourth courses, and wherein the fastener is screw threadably received through the second, third and fourth courses of the fastener assembly by the fastener engaging clip.

14. A fastener assembly as claimed in claim 13, and wherein the main body further includes a slot for receiving a prying tool, and wherein force applied by the prying tool provides sufficient torque to disengage the fastener assembly from the first object of interest.

15. A fastener assembly for engaging a lattice structure which includes a plurality of substantially horizontally oriented components, and a plurality of substantially vertically oriented components which individually include a pair of legs which define a gap therebetween, and wherein the horizontal and vertical components define spaces therebetween, the fastener assembly comprising:

a main body having first, second, third and fourth courses, and wherein the courses interact with one of the vertically oriented components of the lattice, and wherein the first course includes forwardly and rearwardly disposed surfaces, and first and second ends, and a midpoint therebetween, and wherein the second course is oriented substantially perpendicular to the first course and further is fixed on the first course at substantially the midpoint of the first course and which extends normally outwardly relative to the forwardly disposed surface of the first course, and wherein the third course is oriented substantially perpendicular to the first course and further is fixed on the first course at the first end of the first course and which extends normally outwardly relative to the forwardly disposed surface of the first course, and wherein the fourth course is oriented substantially perpendicular relative to the first course and further is fixed on the second end of the first course and which extends normally outwardly relative to the forwardly disposed surface of the first course, and wherein the second, third and fourth courses include individual coaxially aligned apertures which are operable to receive a fastener; and a second object of interest is releasably secured on the main body by the fastener, and wherein the second, third and fourth courses are spaced a predetermined distance apart and are operable to engage the lattice like structure thereby securing the second object on the lattice like structure, and wherein the third course further includes forwardly and rearwardly disposed surfaces, upper and lower edges, and first and second ends, and a midpoint therebetween, and wherein the third course is fixed on the first course at substantially the first end of the third course, and wherein the third course further includes a member which is fixed on the upper edge of the third course and extends substantially perpendicularly outwardly relative to the rearwardly disposed surface at substantially the midpoint of the third course, thereby engaging one of the horizontal components of the lattice.

16. A fastener assembly as claimed in claim 15, and wherein the third course further includes a protrusion which extends substantially perpendicularly outwardly relative to the rearwardly disposed surface of the third course at substantially the second end of the third course; and wherein the fourth course further includes forwardly and rearwardly disposed surfaces, first and second ends, and a midpoint therebetween, and wherein the fourth course is fixed on the first course at substantially the first end of the fourth course, and wherein the fourth course further includes a protrusion which extends substantially perpendicularly outwardly relative to the forwardly disposed surface of the fourth course at substantially the second end of the fourth course.

17. A fastener assembly as claimed in claim 16, and wherein the second object of interest includes a first plate, and wherein the first plate has forwardly and rearwardly disposed surface, and wherein the rearwardly disposed surface of the first plate is secured on the main body by the fastener; and wherein a second plate is matingly engaged in interfitted relation with the first plate.

18. A fastener assembly as claimed in claim 17, and wherein the first plate includes a plurality of apertures, and wherein the second plate has a plurality of clips, and wherein the clips are received in the apertures thereby securing the first and second plates together.

19. A fastener assembly as claimed in claim 18, and wherein an adhesive is applied between the first and second plates.

20. A fastener assembly for attaching to a first object of interest comprising a main body having first, second, third and fourth courses, and wherein the first course includes forwardly and rearwardly disposed surfaces, first and second ends and a midpoint therebetween, and wherein the second course is oriented substantially perpendicular to the first course and is fixed on the first course at substantially the midpoint of the first course and extends normally outwardly relative to the forwardly disposed surface of the first course, and wherein the third course is oriented substantially perpendicular to the first course and further is fixed on the first course at substantially the first end of the first course and which further extends normally outwardly relative to the forwardly disposed surface of the first course, and wherein the fourth course is oriented substantially perpendicular relative to the first course and further is fixed on substantially the second end of the first course and which extends normally outwardly relative to the forwardly disposed surface of the first course, and wherein the fourth course further includes a first and second end and a midpoint therebetween, and wherein the fourth course is fixed on the first course at substantially the first end of the fourth course, and wherein the fourth course further includes a camming member fixed on the second end of the fourth course, and wherein the camming member further includes first, second and third courses, and wherein the first course of the camming member has first and second ends, and wherein the first end of the first course of the camming member is fixed at a predetermined angular orientation on the second end of the fourth course, and wherein the second course of the camming member includes first and second ends, the second course of the camming member is oriented substantially perpendicular to the first course of the camming member, and wherein the first end of the second course of the camming member is fixed on the second end of the first course of the camming member, and wherein the third course of the camming member includes first and second ends, and wherein the third course of the camming member is oriented substantially perpendicular to the second course of the camming member, and wherein the first end of the third course of the camming member is fixed on the second end of the second course of the camming member, and wherein the main body further includes a slot for receiving a tool, and wherein force imparted by the tool provides sufficient torque to disengage the fastener assembly from the object of interest, and wherein the second, third and fourth courses of the main body further include individual substantially coaxially aligned apertures which are operable to receive a fastener, and wherein the third course of the main body further includes forwardly and rearwardly disposed surfaces, first and second ends and a midpoint therebetween, and wherein the third course is fixed on the first course at substantially the first end of the third course, and wherein the third course further includes a protrusion which extends substantially perpendicularly outwardly relative to the rearwardly disposed surface of the third course at substantially its second end, and wherein the fourth course further includes forwardly and rearwardly disposed surfaces, and wherein the fourth course further includes a protrusion which extends substantially perpendicularly outwardly relative to the forwardly disposed surface of the fourth course at substantially its second end; and wherein a second object of interest is secured on the first object by means of the fastener, and wherein the second, third and fourth courses engage the first object of interest thereby securing the second object on the first object of interest.

* * * * *

UNITED STATES PATENT AND TRADEMARK OFFICE

CERTIFICATE OF CORRECTION

PATENT NO. : 5,547,306
DATED : August 20, 1996
INVENTOR(S) : Jerry Zakrajsek

It is certified that error appears in the above-indentified patent and that said Letters Patent is hereby corrected as shown below:

Col. 8, line 11, after "lattice" delete --like--.

Col. 8. line 37, after "lattice" delete --like--.

Signed and Sealed this

Eleventh Day of February, 1997

Bruce Lehman

*Attest:*

BRUCE LEHMAN

*Attesting Officer*

*Commissioner of Patents and Trademarks*